US009168536B2

(12) United States Patent
Peterson

(10) Patent No.: US 9,168,536 B2
(45) Date of Patent: Oct. 27, 2015

(54) VERTICAL VORTEX GENERATING SLUICE/SLURRY SEPARATOR

(71) Applicant: David S. Peterson, Kalispell, MT (US)

(72) Inventor: David S. Peterson, Kalispell, MT (US)

( * ) Notice: Subject to any disclaimer, the term of this patent is extended or adjusted under 35 U.S.C. 154(b) by 18 days.

(21) Appl. No.: 14/194,719

(22) Filed: Mar. 1, 2014

(65) Prior Publication Data

US 2015/0246359 A1 Sep. 3, 2015

Related U.S. Application Data

(60) Provisional application No. 61/771,174, filed on Mar. 1, 2013.

(51) Int. Cl.
*B03B 5/26* (2006.01)
*B03B 5/40* (2006.01)

(52) U.S. Cl.
CPC ... *B03B 5/26* (2013.01); *B03B 5/40* (2013.01); *B03B 2005/405* (2013.01)

(58) Field of Classification Search
CPC ..... B03B 5/06; B03B 5/26; B03B 5/40; B03B 5/62; B03B 5/10; B03B 2005/405
USPC ..... 209/454, 458, 459, 461, 494, 506, 208, 209/210
See application file for complete search history.

(56) References Cited

U.S. PATENT DOCUMENTS

| | | | | |
|---|---|---|---|---|
| 1,050,598 | A * | 1/1913 | Bassett | 209/458 |
| 4,290,527 | A * | 9/1981 | Wright | 209/458 |
| 4,592,833 | A * | 6/1986 | Perdue | 209/44 |
| 5,287,975 | A * | 2/1994 | Chumley et al. | 209/3 |
| 5,785,182 | A * | 7/1998 | Ashcraft | 209/44 |
| 6,308,835 | B1 * | 10/2001 | Wade | 209/691 |

* cited by examiner

*Primary Examiner* — David H Bollinger
(74) *Attorney, Agent, or Firm* — Law Office of Craig Bohn; Craig E. Bohn

(57) ABSTRACT

A sluice box separator apparatus having a curved partition wall to shape the water flow into a horizontal vortex, inducing lighter material to exit the vortex with the water, and the denser materials to settle into a well located beneath the location of the induced vortex, including a selectively openable gate between the well and a valuable material recovery chamber.

14 Claims, 8 Drawing Sheets

VERTICAL VORTEX GENERATING SLUICE/SLURRY SEPARATOR

CROSS-REFERENCE TO RELATED APPLICATIONS

This application claims the benefit of patent application No. 61/771,174, filed 1 Mar. 2013 by the present inventor.

STATEMENT REGARDING FEDERALLY SPONSORED RESEARCH OR DEVELOPMENT

Not Applicable

BACKGROUND OF THE INVENTION

1. Field of the Invention

This invention generally relates to the field of gold or gem mining, and more specifically to continuous flow sluice boxes.

2. Description of the Related Art

A number of methods are typically used to mine gold and gems from the earth's surface. In this disclosure, the material being mined will be referred to simply as "gold," but other heavy metals, valuable materials and gems may still be includable in that term. This disclosure will also use the term "deposit material" to refer to the mix of gold and non-gold naturally found at a mining site. The simplest technique to separate gold from the non-gold material is panning. In panning some deposit material is placed in a large plastic or metal pan, along with a generous amount of water. The pan is then agitated so that the gold particles, being of higher density than the non-gold material, settle to the bottom. The non-gold material is flushed from the pan with the water, leaving the desired gold left in the bottom of the pan. Concentric, circumferential ribs are frequently added to the sides of the pan to provide additional low spots for the gold to settle during agitation.

The agitation in a pan can be circular or linear, and is caused by the motion of the pan in the hands of the miner. The waves created by the motion accelerate the non-gold particles, and keep them suspended, while the denser settle to the low spots in the pan.

Sluice boxes and rocker boxes work on a similar principle, just on a slightly larger scale. Rocker boxes tend to be slightly smaller, and both the deposit material and water are generally fed by hand. Improvements include using a filter blanket on the bottom of the box to capture the fine pieces of gold. Sluice boxes, as their name implies, are fed by a sluice, or water flow. Parallel ridges on the bottom of the sluice box, perpendicular to the flow of water, trap the heavier gold particles as the water washes them, while the non-gold material is removed with the water. The pitch of the sluice box and the rate of the water flow can be adjusted to optimize capture of the particular size of gold particles in the deposit material.

The side to side agitation of the rocker box, and the latter will slow agitation of the sluice box, both are seen to create horizontal swirls, or vortices, that agitate the deposit material. The non-gold material is accelerated in the swirled flow, and thereby continues to be suspended in the swirling water. The gold, however, because it is being denser, resists the swirling motion and settles in the low spots in the boxes.

It would be a valuable addition to the prior art to have a sluice box that avoids horizontal sluice riffles and matting, which rely on a horizontal vortex. Horizontal vortices easily become overloaded with heavy material and allow the loss of desired materials. Additionally, horizontal vortices at high flow rates can accelerate even the desired heavy material, such as gold, ejecting it with the runoff water. Further, traditional sluices require suspension of operation and dismantling in order to recover the collected gold, or clean the box after an overload. Such an addition, embodied in the current disclosure, lead to increased feed rates of material, optimum material separation and collection. Additionally, collection can be achieved while running the sluice box or if the box can be automated. Further, the current disclosure permits the owner to configure a sluice box system to secure gold laden collected materials in a locked container for periodic retrieval by authorized individuals.

BRIEF DESCRIPTION OF THE DRAWINGS

The invention will be explained in conjunction with an illustrative embodiment shown in the accompanying drawings, in which.

DESCRIPTION OF THE ILLUSTRATED EMBODIMENT

Figure 1:
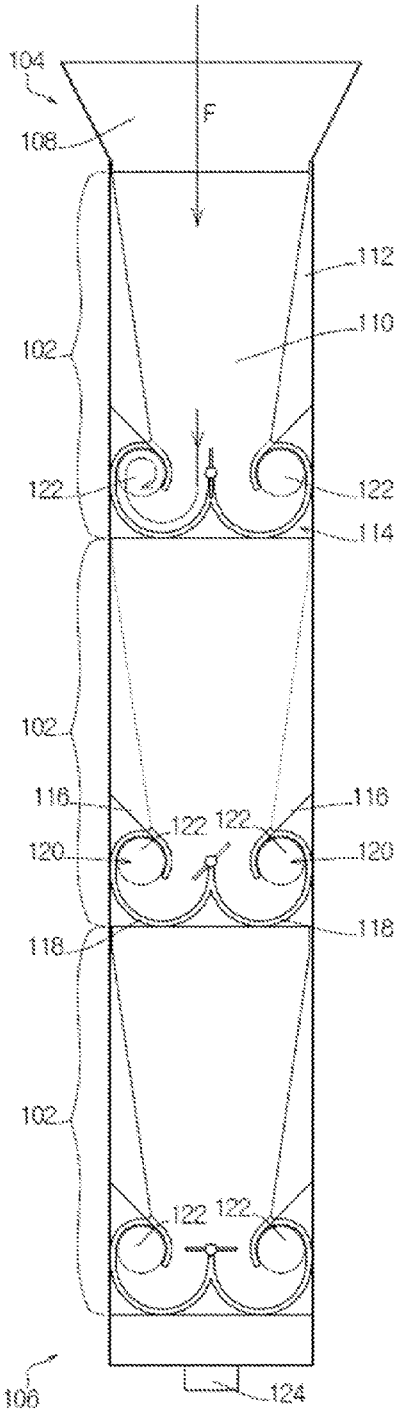
FIG. 1 is a schematic top view of an exemplary sluice box with the vortex generators according to the present disclosure.
Figure 2:
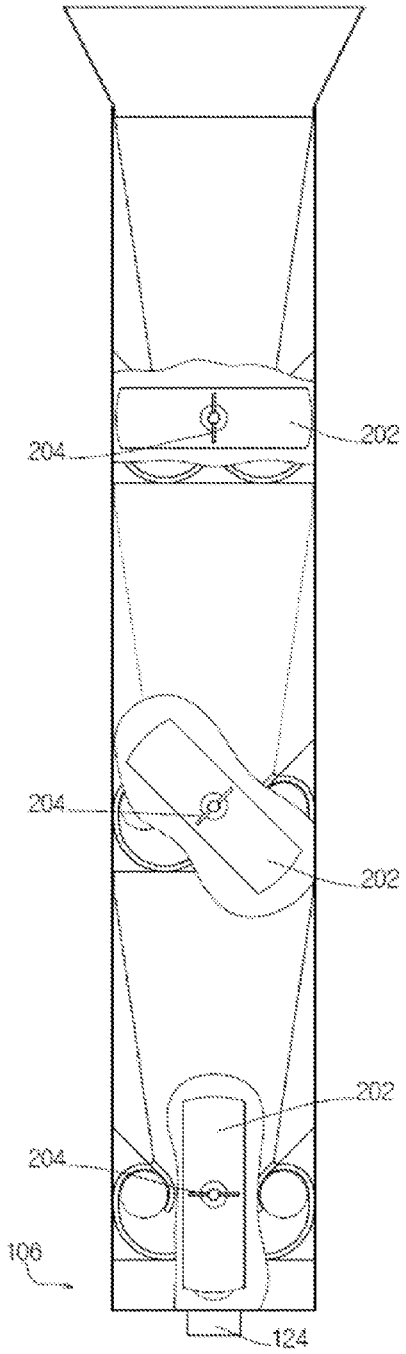
FIG. 2 is a partially cut-away top view of the sluice box in FIG. 1, showing an exemplary collection well gate valve.

Now, referring to FIGS. 1 and 2, an exemplary sluice box 100 having three vortex sections 102 is shown oriented such that the end that typically receives the flow of water F, containing deposit material, as it enters the sluice box 100, referred to as the feed end 104, is at the top of the illustration. The discharge end 106 is oriented to the bottom of the illustration. The feed end 104 has a feed 108 for directing the flow of water F into the series of vortex sections 102. Exemplary sluice box 100 has a generally flat and smooth box for 110 bordered on each side by box walls 112. Each exemplary vortex section 102 has a vortex generator 114 for creating a vertical vortex in the water flow F.

The exemplary vortex generator 114 has a feed diverter 116 and a vortex wall 118 that direct the flow of water into the vortex loop 120. And exemplary collection well 122 is located at the vortex loop 120. Gate valve 202 is selectable between an open and a closed position. In the closed position gate valve 202 seals the contents of the collection well 122 from below. In the open position gate valve 202 permits the contents of collection well 122, and some water, to drop into a plenum section below the box floor 110. Valve lever 204 is used to transition the gate valve 202 between the open position and the closed position.

In operation, the exemplary sluice box 100 is oriented generally horizontally from side to side, and at a desired slope downward from the feed end 104 to the discharge end 106. Water is directed to flow along a box floor 110, contained within the sluice box 100 by generally parallel box walls 112 on both sides of the vortex section 102. Water exit the sluice box 100 at the discharge end 106, either over the top of the last vortex generator 114, or into the plenum chamber under the vortex section 102, and out the plenum drain 124.

Figure 3:
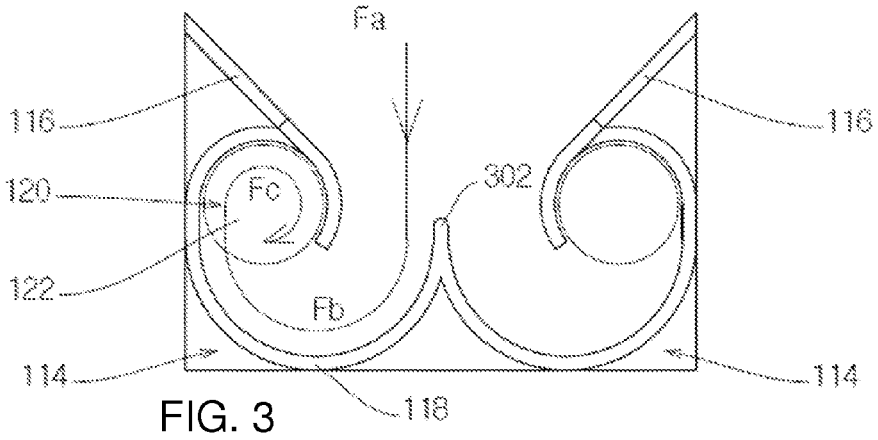
FIG. 3 the schematic top view of an exemplary vortex generator, with an illustration of the general water flow.
Figure 4:
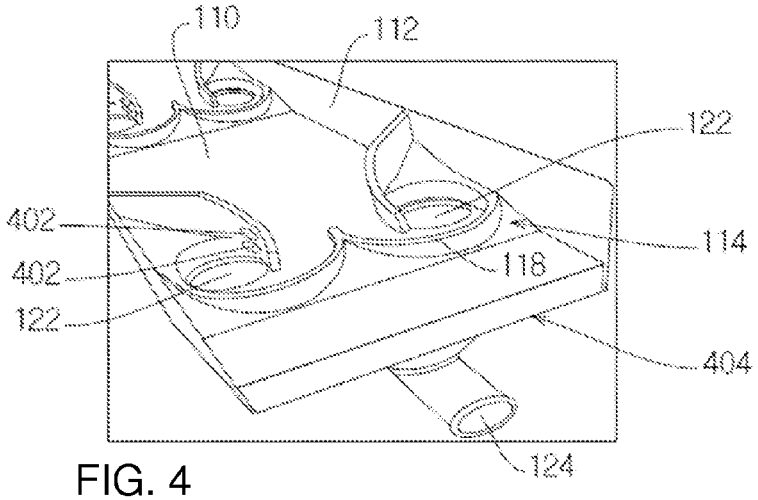
FIG. 4 is a perspective view of an exemplary vortex generator and an exemplary plenum drain.

Referring now to FIGS. 3 and 4, a single exemplary vortex section 102 is shown. The flow of water transporting deposit material is directed within the vortex section 102 by a variety of elements. Feed diverter 116 is positioned to meet the flow first. To handle the volume and force of the water, feed diverters 116 may extend upward from the box floor 110 a greater amount than other portions of a vortex generator 114. The exemplary vortex section 102 is configured with two vortex generators 114 oriented in a mirror positioned, side-by-side between the box walls 112. A vortex finder 302 connects the two vortex generator 114, and is oriented pointing toward the oncoming full water. A vortex wall 118 curves generally in the direction of the prospective water flow and outward from the vortex finder 302, to the box wall 112, and curl behind the backside of a respective feed diverter 116, creating the vortex loop 120. Flow ports 402 maybe position through the diverter 116 and vortex loop 120 in order to direct some water flow directly into the vortex loop 120, in order to avoid the creation of vacuum pockets that could disturb material in the collection well 122.

During operation water flows into vortex section 102 as symbolized by initial flow Fa. The feed diverter 116 directs the water flow toward the center of the vortex section 102 where it encounters vortex finder 302. Vortex finder 302 forces the flow into a single vortex generator 114. At this point curved flow Fb is forced into a horizontal turn along vortex wall 118. The vortex flow Fc completes the horizontal vortex within vortex loop 120. Throughout the progression through curved flow Fb and vortex flow Fc deposit material is segregated, with the less dense material remaining suspended in the water to travel along the entire will route, for escape over the top of vortex wall 118. The greater density material, such as gold, settles to the box floor 110, where curved flow Fb and vortex flow Fc sweep it to the vortex loop 120 until it settles into the recess of collection well 122. During heavy flow and heavy throughput some gold may progress over the vortex wall 118. Arranging multiple vortex section 102 in sequence allows for such temporary loss, but such gold will be caught by subsequent vortex section 102.

Figure 5:
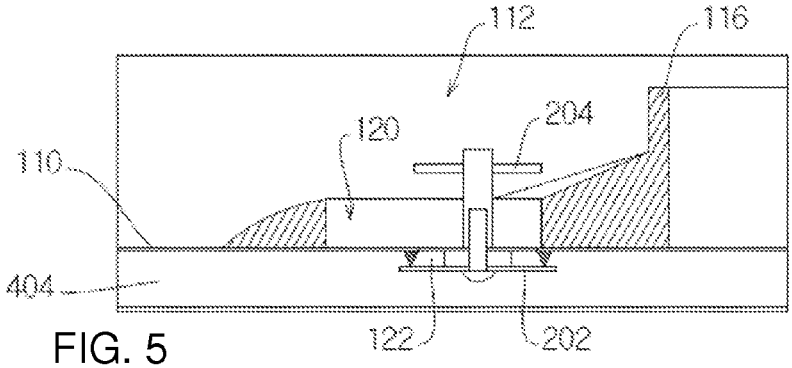
FIG. 5 is a partially cut-away side view of an exemplary collection well gate valve positioned in an exemplary vortex generator.

Referring now primarily to FIGS. 2 and 5, an exemplary plenum 404 is shown oriented beneath the box floor 110. An exemplary plenum can serve as a valuable material recovery chamber into which gold can flow, and from which access may be restricted. In the closed position, gate valve 202 retains desired materials in the collection well 122. By temporarily moving gate valve 202 into the open position, as shown in the middle and bottom vortex generators 114 in FIG. 2, material collected in collection well 122 is permitted to be flushed into the plenum 404, along with a quantity of water. The water and the slope of the sluice box 100 effect the transportation of the desired material to the discharge and 106, and out plenum drain 124. In alternate exemplary embodiments gate valve 202 may be configured for automated operation, where valve lever 204 could be replaced by a controllable actuator.

Figure 6:
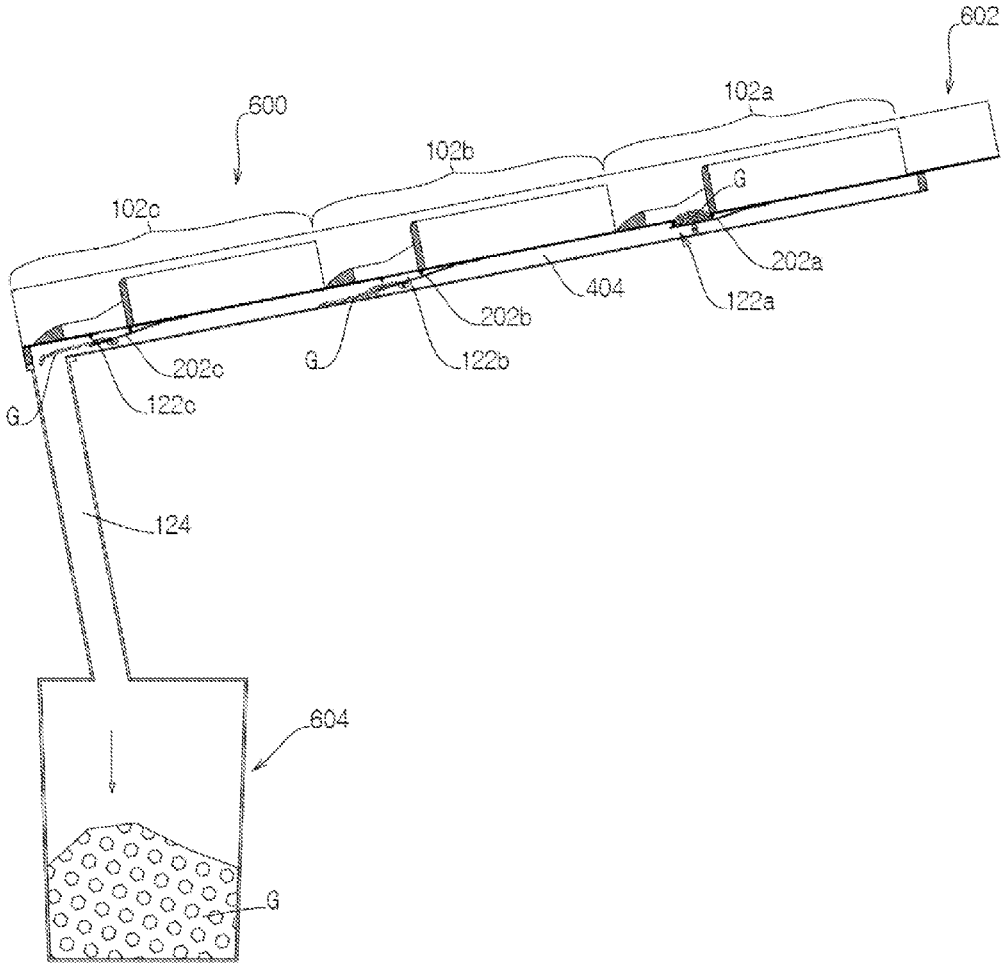
FIG. 6 is a schematic cut-away side view of a sluice box capture system according to the present disclosure.

Referring now to FIG. 6, an exemplary integrated sluice box system 600 is shown to include sluice box 602 connected to a vault 604 by plenum drain 124. Exemplary sluice box 602 comprises an upper vortex section 102*a*, a middle vortex section 102*b*, and a lower vortex section 102*c*. Gold G is depicted as collected by each vortex section 102. Exemplary vortex section 102*a* is shown with its respective gate valve 202*a* in the closed position. As such, gold G separated by vortex section 102*a* is retained in collection well 122*a*. Exemplary sections 102*b* and 102*c* are shown with their respective gate valves 202*b* and 202*c* in the open position. As such, gold G separated by vortex sections 102*b* and 102*c* has flowed into plenum 404. Plenum 404 is connected to drain 124, which is in turn connected to vault 604.

The connection from plenum 404 through drain 124 and into vault 604 may be constructed in such a fashion as to prevent the removal of gold from this enclosed sluice box system 600. In an exemplary embodiment already discussed, the plenum may have been used as a valuable material recovery chamber into which gold can flow, and from which access may be restricted. The integrated vault 604 may provide additional security and options for restricted access and recovery of the gold captured by the sluice box system 600.

Figure 7A:
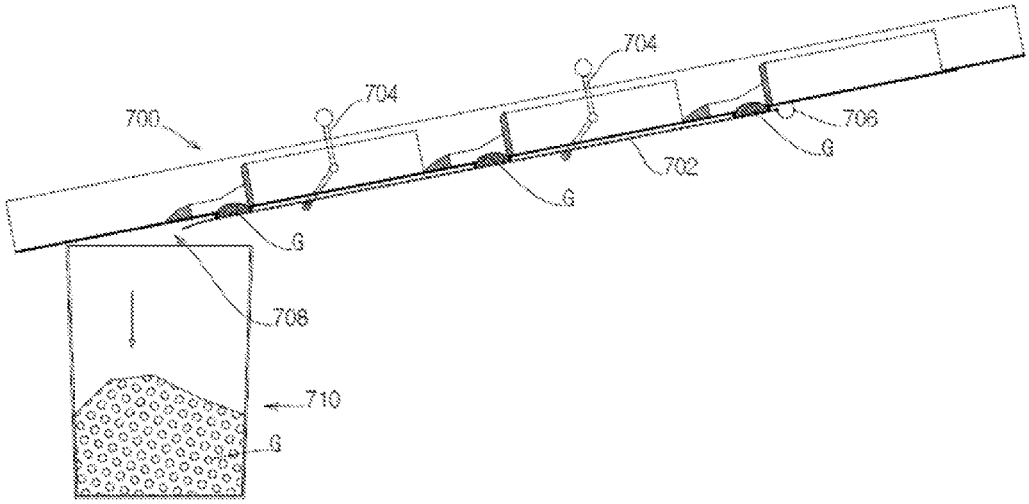
FIGS. 7*a* and 7*b* are schematic cut-away side views of an alternate exemplary sluice box capture system according to the present disclosure.
Figure 7B:
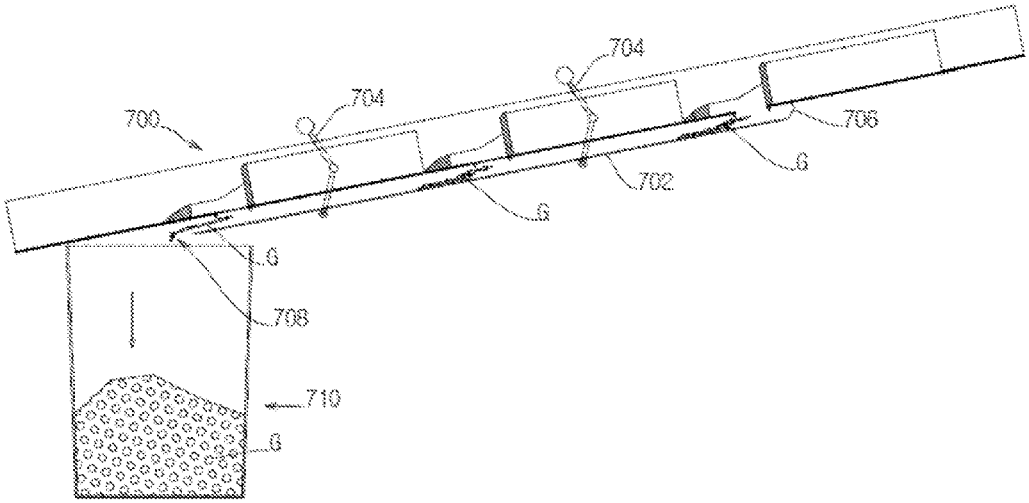

Referring now to FIGS. 7*a* and 7*b*, an alternate exemplary integrated sluice box system 700 is shown. Alternate system 700 is similar to system 600, but illustrates variations that may be made within the scope of this disclosure. Alternate system 700 has a single gate valve 702 controlled by a plurality of valve levers 704. Exemplary gate valve 702 may be constructed of a durable, rigid material that maintains a linear shape over its entire length from hinge 706 to drain 708.

Figure 8A:
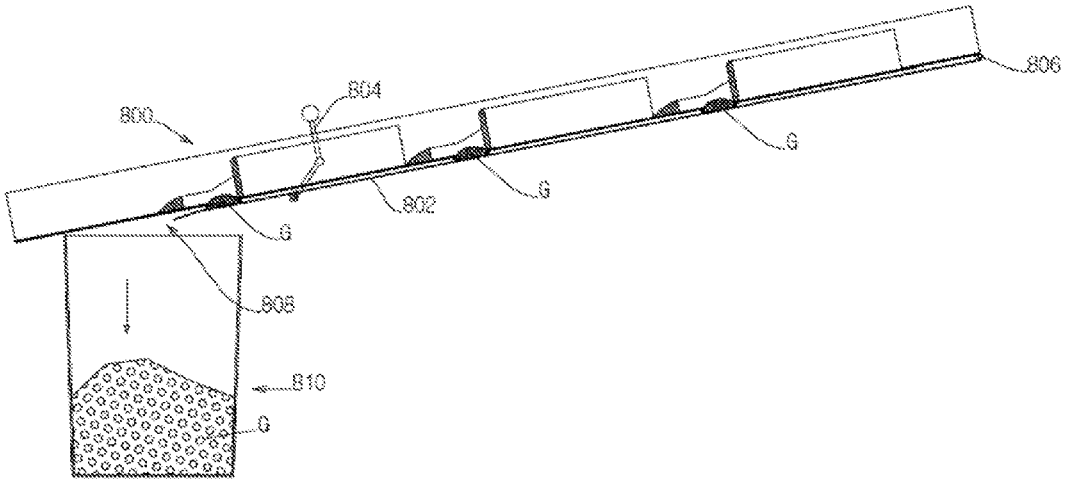
FIGS. 8*a* and 8*b* are schematic cut-away side views of an additional alternate exemplary sluice box capture system according to the present disclosure.
Figure 8B:
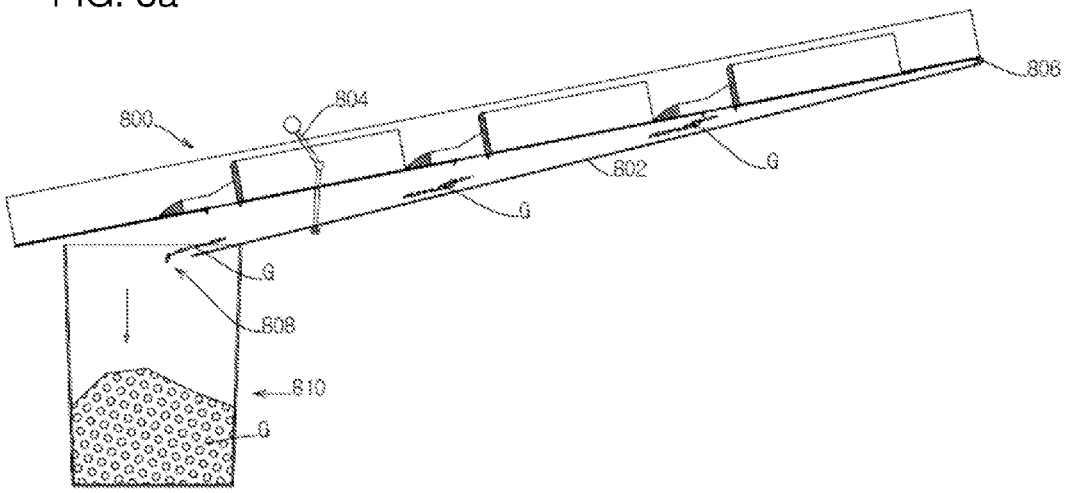

Referring now to FIGS. 8*a* and 8*b*, an additional alternate exemplary integrated sluice box system 600 is shown. Additional alternate system 800 is similar to system 600, but illustrates other variations that may be made within the scope of this disclosure. Alternate system 800 has a single gate valve 802 controlled by a single of valve lever 804. Exemplary gate valve 702 may be constructed of a durable, rigid material that maintains a linear shape over its entire length from hinge 806 to drain 808.

Figure 9A:
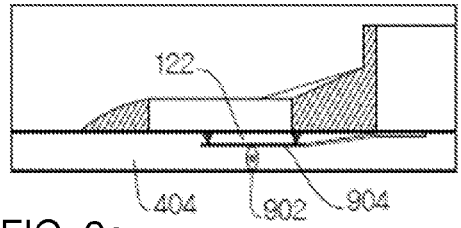
FIGS. 9*a* and 9*b* are partially cut-away side views of an alternate exemplary collection well gate valve in an open and then in a closed position.
Figure 9B:
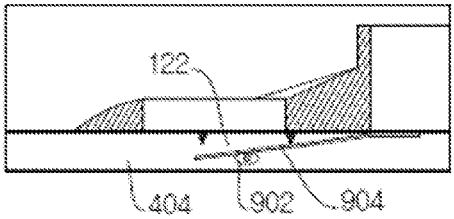

Referring now to FIGS. 9*a* and 9*b*, an alternate exemplary valve lever 902 is shown placing valve 904 selectively in a closed and an open position, respectively. The rotation of oblong valve lever 902 by an actuator (not shown) selectively binds gate valve 904 against the bottom of collection well 122, preventing gold and water from entering the plenum 404. Additional rotation of the oblong 902 by an actuator (not shown) alternatively open the gate valve 904 and releases gold and water from the collection well 122 into the plenum 404.

Figure 10A:
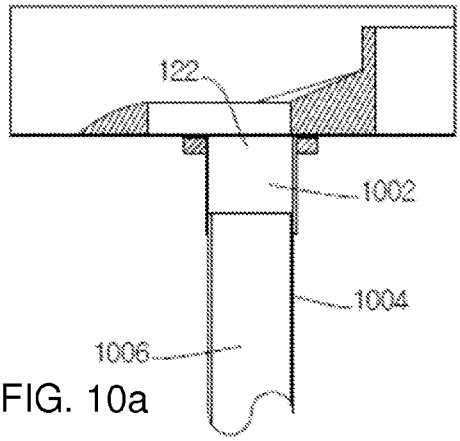
FIGS. 10*a* and 10*b* are partially cut-away side views of an additional alternate exemplary collection well gate valve in an open and then in a closed position.
Figure 10B:
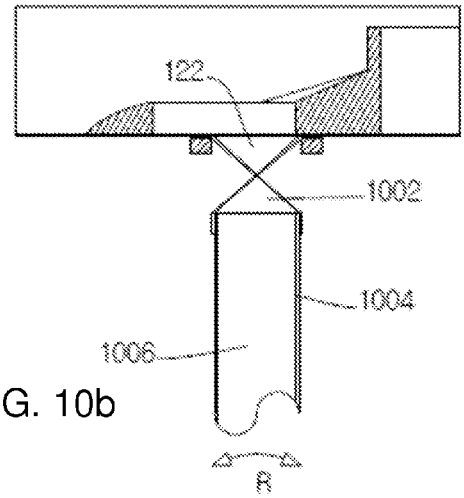
Figure 11A:
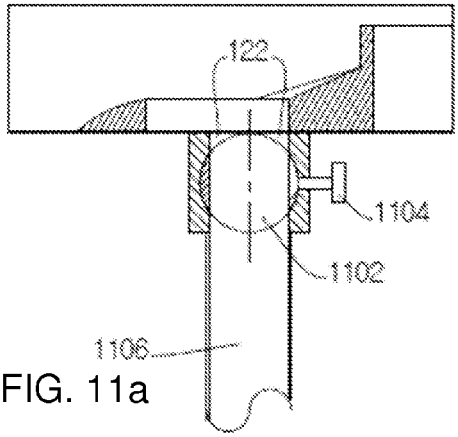
FIGS. 11*a* and 11*b* are partially cut-away side views of a further additional alternate exemplary collection well gate valve in an open and then in a closed position.
Figure 11B:
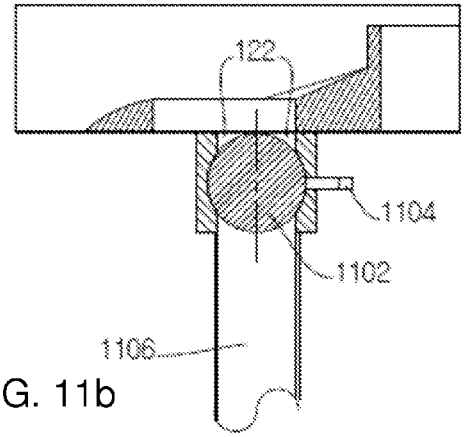

Referring now to FIGS. 10*a* and 10*b*, and additional alternate exemplary valve—an iris valve 1002—is shown. Iris valve 1002 is selectively operated between and open position and a closed position by the rotation R of valve actuator 1004. In the open position gold and water may flow through iris valve 1002 and drain 1006, which is a linear void through a length of valve actuator 1004. Referring now to FIGS. 11*a* and 11*b*, a further alternate exemplary valve—a ball valve 1102—actuated between an open and a closed position, respectively by valve lever 1104, is shown. In the open position exemplary ball valve 1102 permits the flow of gold from collection well 122 to drain 1106.

As with the other embodiments shown as examples of how to use the teachings of this disclosure, the inventor envisions that the variations shown in exemplary embodiments of the system 600, system 700, and system 800, as well as valve 900, valve 1000, and valve 1100 are not the only variations that can be made within the scope of this disclosure.

Figure 12A:
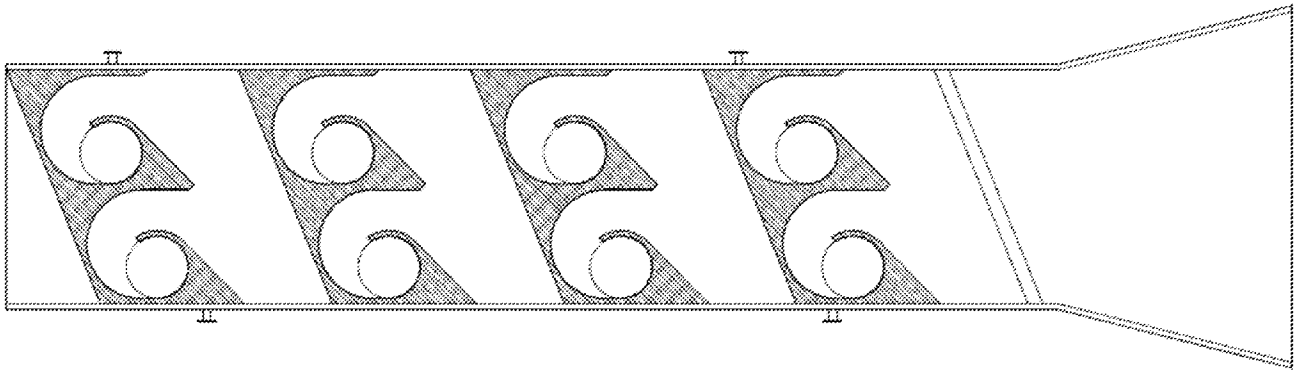
FIG. 12*a* is the top view of an alternate exemplary embodiment of the vertical vortex sluice box of the present invention.
Figure 12B:
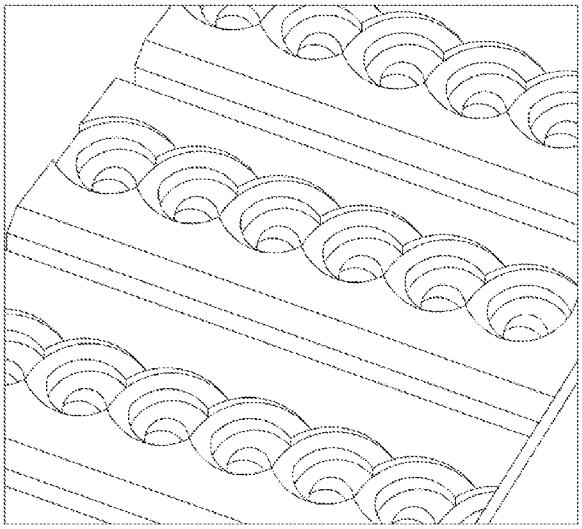
FIG. 12*b* is a perspective top view of an alternate exemplary embodiment of a vortex section according to the present invention.
Figure 12C:
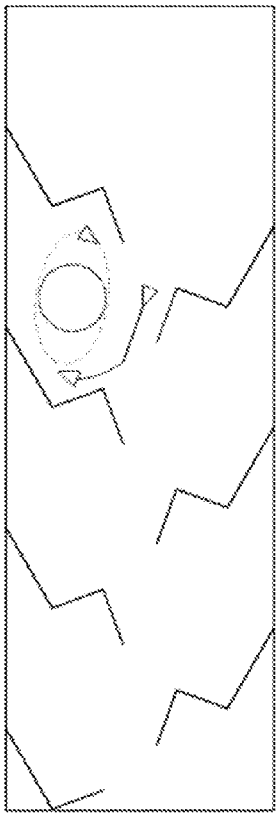
FIG. 12*c*-12*f* are schematic top views of alternate exemplary embodiments of the vertical vortex sluice box, according to the present invention.
Figure 12D:
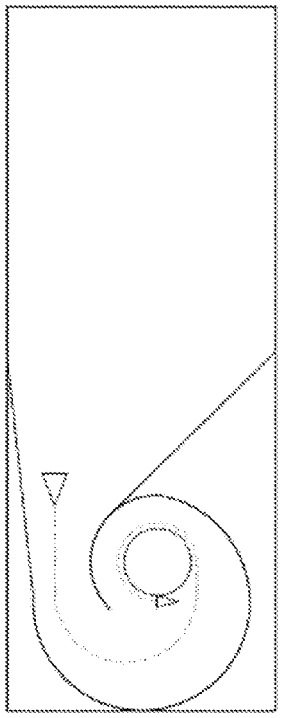
Figure 12E:
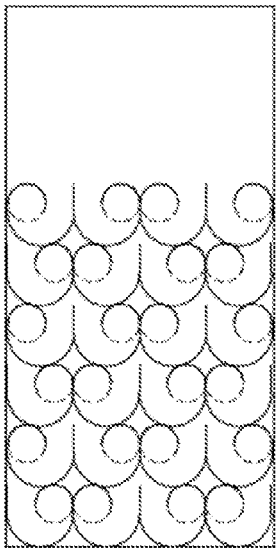
Figure 12F:
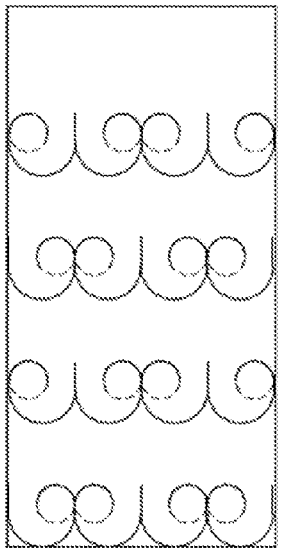

FIGS. 12*a*-12*f* illustrate a few of the many prototypes shown to generate horizontal vertices effective in separating gold from deposit material. FIGS. 12*a* and 12*c* illustrate that the four text generator does not need to be oriented perpendicular to the sidewalls. FIG. 12*b* illustrates that the vortex generator may be recessed into the floor of the sluice box, and may be configured without the drain at the bottom of the collection well. FIGS. 12*b*, 12*d*, 12*e* and 12*f* are examples that illustrate that the vortex generator may be oriented in other configurations than simply pairs. FIG. 12*b* illustrates that six vortex generators may be oriented in a horizontal row, either with an intermediate trough, as shown, or without (not shown). FIG. 12*d* illustrates that a single vortex generator may be oriented by itself. FIGS. 12*e* and 12*f* illustrate that the vortex generators may be staggered for uniform with in the sluice box, and maybe spaced apart for position to abut an adjacent row. Several of these exemplary embodiments are describe in U.S. patent application No. 61/771,174, filed 1 Mar. 2013 by the present inventor, which is hereby incorporated by reference in order to ensure any patentable subject matter therein disclosed is available to this disclosure.

These examples illustrate only a few configurations that are considered by the inventor within the scope of this disclosure. The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A material separator orientable within a sluice channel defined by a box floor and box sides comprising:

a vortex generator having a curved vortex wall oriented so as to smoothly curve at least a portion of a directional flow of water in the sluice channel back into a subsequent flow of water so as to create a water vortex with a vertical axis of rotation; and the vertical axis of rotation passing through a recessed collection well in the box floor.

2. The material separator of claim 1, further comprising:

an openable gate between the well and a valuable material recovery chamber.

3. The material separator of claim 1, further comprising:

an gate intermediate the well and a valuable material recovery chamber operable between an open and a closed position; and the closed position facilitating collection of valuable material in the well, and the open position facilitating the evacuation of the valuable material from the well.

4. The material separator of claim 1, further comprising:

the curved wall protruding upwardly from the box floor.

5. The material separator of claim 1, further comprising:

the curved wall recessed onto the box floor.

6. The material separator of claim 5, further comprising:

an openable gate intermediate the well and a valuable material recovery chamber.

7. A sluice box floor operational in a directional flow of water in a sluice channel comprising:

a vortex generator having a curved vortex wall oriented so as to smoothly curve at least a portion of the directional flow of water in the sluice channel back into a continuing flow of water so as to create a water vortex with a vertical axis of rotation; and the vertical axis of rotation passing through a recessed collection well in the box floor.

8. The sluice box floor of claim 1, further comprising:

an openable gate intermediate the well and a valuable material recovery chamber.

9. The sluice box floor of claim 1, further comprising:

the valuable material recovery chamber secureable so as to provide restricted access to contents of the chamber.

10. The sluice box floor of claim 1, further comprising:

a gate intermediate the well and a valuable material recovery chamber operable between an open and a closed position; and the closed position facilitating collection of valuable material in the well, and the open position facilitating the evacuation of the valuable material from the well.

11. The sluice box floor of claim 1, further comprising:

the valuable material recovery chamber secureable so as to provide restricted access to contents of the chamber.

12. The sluice box floor of claim 1, further comprising:

the curved wall protruding upwardly from the box floor.

13. The sluice box floor of claim 1, further comprising:

the curved wall recessed onto the box floor.

14. The sluice box floor of claim 13, further comprising:

an openable gate intermediate the well and a valuable material recovery chamber.

* * * * *